United States Patent [19]

Munter et al.

[11] Patent Number: 4,751,423

[45] Date of Patent: Jun. 14, 1988

[54] PHOTOCATHODE HAVING A LOW DARK CURRENT

[75] Inventors: Bernard Munter, Seyssinet Paris; Paul de Groot, Grenoble; Claude Weisbuch, Paris; Yves Henry, Eybens, all of France

[73] Assignee: Thomson CSF, Paris, France

[21] Appl. No.: 933,923

[22] Filed: Nov. 24, 1986

[30] Foreign Application Priority Data

Nov. 29, 1985 [FR] France ..... 85 17718

[51] Int. Cl.[4] ..... H01J 31/26; H01J 40/06

[52] U.S. Cl. ..... 313/366; 357/3; 357/30

[58] Field of Search ..... 313/366, 368, 542, 499, 313/501; 357/17, 30, 31, 3, 16

[56] References Cited

U.S. PATENT DOCUMENTS

| | | | |
|---|---|---|---|
| 3,743,899 | 7/1973 | Anthony et al. | 313/366 |
| 3,958,143 | 5/1976 | Bell | 313/542 |
| 4,015,284 | 3/1977 | Hara et al. | 357/16 |
| 4,587,456 | 5/1986 | Inoue et al. | 313/366 |

FOREIGN PATENT DOCUMENTS 2259442 1/1975 France .

OTHER PUBLICATIONS

IEEE Electron Device Letters, vol. EDL-2, No. 5 mai 1981, pp. 123-125.

*Primary Examiner*—David K. Moore
*Assistant Examiner*—K. Wieder
*Attorney, Agent, or Firm*—Cushman, Darby & Cushman

[57] ABSTRACT

A photocathode having a low dark current comprises a first layer consisting of P+ type semiconductor material which is transparent to all wavelengths of the light to be detected, a second layer consisting of P+ type semiconductor in which the forbidden band is of sufficiently small width to convert the photons of the light to be detected into electron-hole pairs, at least one intercalary layer located within the second layer and consisting of P-type or N-type semiconductor material for creating a potential barrier with respect to the second layer, the thickness of said intercalary layer being of sufficiently low value to permit the passage of electrons by tunnel effect with high probability but of sufficiently high value to stop the greater part of a hole current, a metallic electrode for biasing the photocathode in order to accelerate the electrons of the electron-hole pairs created within the second layer by the light, a last layer for reducing the energy-gap potential with respect to the second layer in order to emit into the vacuum the electrons which have thus been accelerated.

5 Claims, 2 Drawing Sheets

PHOTOCATHODE HAVING A LOW DARK CURRENT

BACKGROUND OF THE INVENTION

This invention relates to a photocathode for use in pickup tubes at very low light levels as well as to a television camera tube or an image intensifier tube.

It is known to construct a photocathode having the following main components:

- a so-called window layer consisting of P+ type semiconductor in which the forbidden band is of sufficient width to ensure that said layer is transparent to the wavelengths of the light to be detected and which is bonded to a glass wall for receiving the light to be detected;
- a so-called absorption layer consisting of a P+ type semiconductor in which the forbidden band is of sufficiently small width to convert the light photons to be detected into electron-hole pairs;
- a so-called emission layer consisting of material which produces negative electron affinity at the end of the absorption layer in order to emit into vacuum the electrons which are released within the absorption layer.

In the absence of a bias applied to the absorption layer, negative electron affinity can be achieved only in the case of materials having a forbidden bandwidth greater than a predetermined limit, which imposes a limit above the detectable wavelength. A positive bias applied to the absorption layer permits the fabrication of photocathodes having good photoemissive efficiency with materials which have a smaller forbidden bandwidth and therefore absorb longer wavelengths. A bias can be applied to the absorption layer by means of a connection with said layer or by a very thin metallic electrode interposed between said layer and the emission layer. A photocathode of this type is described in the article by J. J. Escher et al., IEEE-EDL2, 123–125 (1981).

This type of photocathode has the disadvantage of high dark emission. In fact, a high hole current flows within the window layer and the absorption layer. This hole current produces electron-hole pairs within the absorption layer by ionization, thus generating a parasitic electron flow which is emitted into vacuum by the emission layer. These electrons constitute a strong background noise, which is objectionable when taking pictures at very low light levels. Moreover, the hole current is the cause of high power consumption and has the effect of heating-up the photocathode.

The aim of the invention is to produce a photocathode having a lower dark current than photocathodes of known types. The object of the invention is a photocathode having layers similar to those of the photocathode of known type but further comprising within the absorption layer one or a number of additional layers formed of semiconductor material having a forbidden band of greater width than that of the material of the absorption layer and having a thickness such that said layer or layers are practically transparent to the electron current and are practically opaque to the hole current.

SUMMARY OF THE INVENTION

In accordance with the invention, a photocathode having a low dark current comprises a so-called absorption layer consisting of P+ type semiconductor material having a forbidden band of sufficiently small width to convert the photons of the light to be detected into electron-hole pairs and further comprises at least one additional layer consisting of semiconductor material such as to ensure that said additional layer has the highest possible potential barrier within the valence band while permitting good transmission of electrons, the thickness of said additional layer being sufficiently small to permit the passage of electrons by tunnel effect with a high probability but sufficiently great to stop the greater part of a hole current.

DESCRIPTION OF THE PRIOR ART

Figure 1:
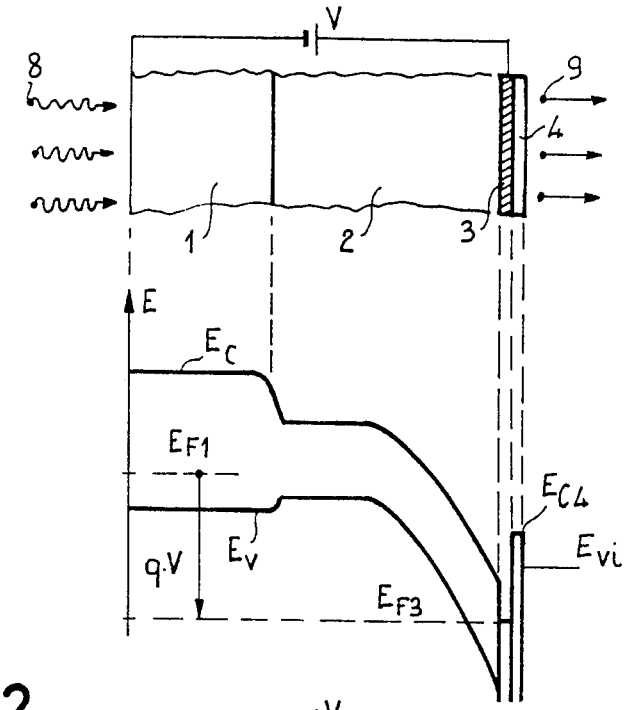
FIG 1 (PRIOR ART)
FIG. 1 is a sectional view showing a portion of one example of construction of a photocathode of known type and a diagram representing the profile of the energy band extremes in said photocathode.

In FIG. 1, one example of construction of the photocathode of known type comprises:

- a window layer 1 of P+ type material consisting of $Ga_{0.6}Al_{0.4}As$ having a thickness of 1 micron and doped with $5\times10^{17}$ atoms of zinc per $cm^3$, the sole function of this layer being to absorb the stresses arising from bonding of the photocathode to a glass wall and to constitute a window for receiving and transmitting photons 8;
- an absorption layer 2 of P+ type semiconductor material such as, for example, GaAs having a thickness of 1 micron and doped with $10^{18}$ atoms of zinc per $cm^3$, the function of this layer being to convert each photon transmitted by the layer 1 into an electron-hole pair;
- a metallic electrode 3 consisting of silver having a small thickness such as 0.005 micron, for example, or a grid of silver and connected to the positive terminal of a generator for producing a voltage V, the negative terminal of which is connected to the layer 1;
- a very thin emission layer 4 consisting of $C_s+O$ for emitting into vacuum electrons 9 delivered by the layer 2.

The diagram of carrier energies represents: the energy $E_c$ of the conduction band and the energy $E_v$ of the valence band in the semiconductor materials of the layers 1 and 2; the Fermi energy $E_{F1}$ of the layer 1; the Fermi energy $E_{F3}$ of the layer 3; the level $E_{c4}$ of the energy of the conduction band; and the energy-gap potential $E_{vi}$. The width of the forbidden band or in other words $E_c$-$E_v$ in the layer 1 is of sufficient width (2 e.V) to ensure that the light to be detected is not absorbed in the layer 1. On the other hand, the width of the forbidden band in the layer 2 is sufficiently small to permit absorption of all wavelengths of the detected light.

The presence of the layer 4 of $C_s+O$ has the effect of reducing the energy-gap potential $E_{vi}$ to a value below the energy level $E_c$ of the layer 2 in that portion which is nearest the layer 1. There remains a potential barrier between the layer 2 and the vacuum but only to a small depth close to the surface.

If q designates the charge of an electron, the voltage V delivered by the generator produces a reduction q.V in the Fermi energy $E_{F3}$ of the electrode 3 with respect to the level of Fermi energy $E_{F1}$ of the layer 1 and thus imparts an additional kinetic energy to the electrons of the layer 2 in order to cross the potential barriers which exist between the layer 2 and vacuum.

The voltage V thus produces an injection of holes which creates electron-hole pairs within the layer 2 by ionization and thus creates a flow of parasitic electrons which is emitted into the vacuum in the same manner as the electrons of the electron-hole pairs created by the light. This flow of emitted parasitic electrons constitutes a dark current.

DESCRIPTION OF THE PREFERRED EMBODIMENTS

Figure 2:
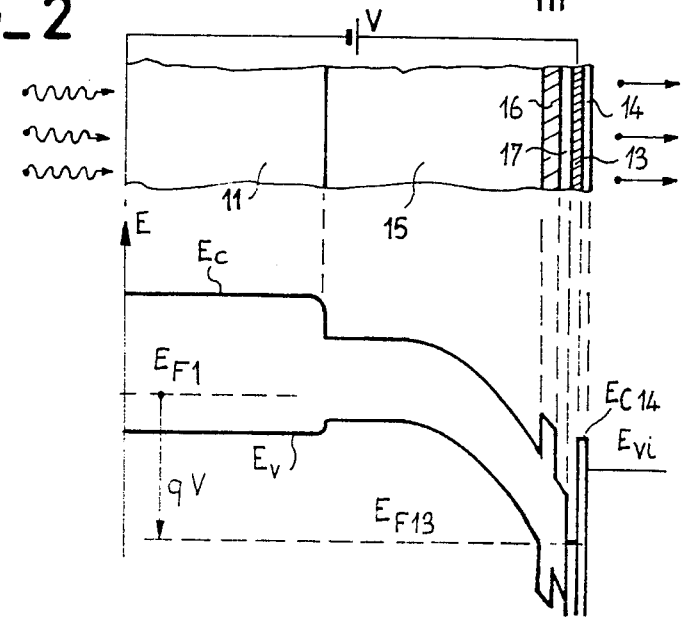
FIG. 2 is a sectional view showing a portion of an exemplified embodiment of the photocathode in accordance with the invention and a diagram representing the profile of the energy band extremes in this embodiment.

FIG. 2 illustrates a first example of construction of the photocathode in accordance with the invention and made up of layers 11, 13 and 14 which are similar to the layers 1, 3 and 4 of the photocathode of known type described in the foregoing. Instead of the layer 2, however, the photocathode in accordance with the invention has three layers 15, 16 and 17. In the same manner as the layer 2, the layers 15 and 17 are formed of $P^+$ type semiconductor material having a smaller forbidden bandwidth than that of the material of the first layer 11 in order to absorb the wavelengths of the light to be detected.

The layer 16 interposed between the layers 15 and 17 is formed of lightly doped P-type semiconductor material having a forbidden bandwidth which is greater than that of the forbidden band of the material of layers 15 and 17 so as to create a potential barrier within the conduction band $E_c$ and a potential barrier within the valence band $E_v$ with respect to the layers 15 and 17. Optimum doping of the layer 16 is that which produces the barrier of greatest depth within the valence band $E_v$ while permitting good transmission of electrons. This barrier is intended to reduce the hole current which flows through the photocathode. Furthermore, the thickness of the layer 16 is chosen so as to be sufficiently small to permit the passage of electrons by tunnel effect with high probability while at the same time being of sufficient value to stop the greater part of the hole current, this difference in transparency of the potential barrier created by the layer 16 being due to the substantial difference in effective mass between the electrons and the holes.

By way of example, the first layer 11 can consist of $Ga_{0.6}Al_{0.4}As$ doped with $5\times10^{17}$ atoms of zinc per $cm^3$ having a thickness of 1 micron, the layers 15 and 17 can consist of GaAs doped with $10^{18}$ atoms of zinc per $cm^3$. The layer 15 has a thickness of 2 microns. The layer 16 can consist of $Ga_{0.6}Al_{0.4}As$ having a thickness of 0.003 micron. The layer 17 has a thickness of 0.1 micron.

Figure 3:
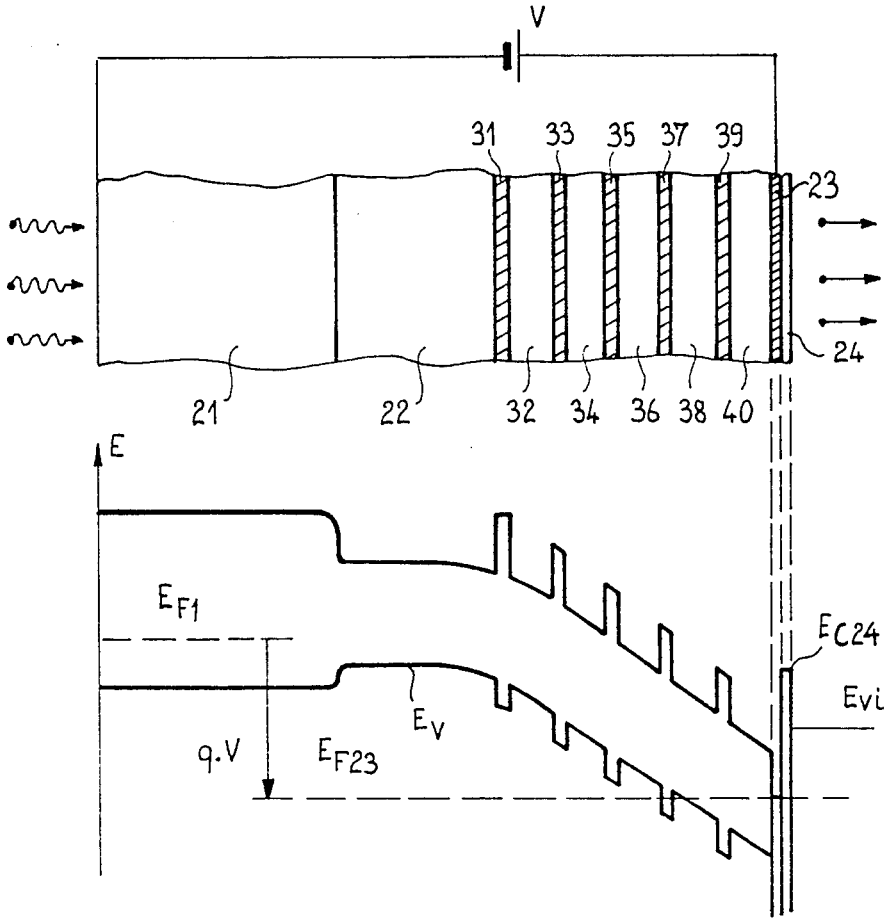
FIG. 3 illustrates an alternative embodiment of the photocathode in accordance with the invention and a diagram representing said profile of energy band extremes in this alternative embodiment.

FIG. 3 illustrates a second example of construction of the photocathode in accordance with the invention in which the dark current can be reduced even further. In this second embodiment, the layer 2 of the photocathode of known type is replaced by layers 22 and 31 to 40. This embodiment includes a window layer 21 and two last layers 23 and 24 which are respectively identical with the layers 1, 3 and 4 of the photocathode of known type. The layers 31 to 40 consist of pairs of layers 31-32, 33-34, 35-36, 37-38, and 39-40 which create five potential barriers in the energy profile of the valence band $E_v$. These five potential barriers add their effects in order to reduce the hole current, thus further reducing the dark current with respect to the value obtained in the first embodiment.

The layers 31, 33, 35, 37, 39 can consist of $Ga_{0.6}Al_{0.4}As$ doped with $10^{18}$ atoms of zinc per $cm^3$ and having a thickness of 0.003 micron. These layers also create five potential barriers within the conduction band $E_c$. As in the case of the layer 16, the thickness of these layers must be sufficiently small to permit the passage of electrons while being of sufficient value to stop the greater part of the holes. The intermediate layers 32, 34, 36, 38, 40 can consist of GaAs which ensures that the forbidden bandwidth is equal to 1.4 eV and is doped with $10^{18}$ atoms of zinc per $cm^3$. By way of example, said intermediate layers can have a thickness of 0.2 micron. Thus, if their thickness is sufficiently great, they can be employed for creating electron-hole pairs by collision of electrons with atoms. At the same time, this thickness must be sufficiently small to ensure that the electrons do not lose their energy in the form of phonons which heat the crystal. The total range of thickness may thus extend from a few hundredths of a micron to a few tenths of a micron.

The layer 22 consists of the same material as the intermediate layers 32, 34 . . . 40 and has a thickness of 1.1 micron.

The invention is not limited to the two examples of construction described in the foregoing and extends to many alternative forms within the capacity of those versed in the art, especially in regard to number, dimensions, materials and doping of the layers and the means for biasing the absorption layer. The layer 22 is formed of $P^+$ type material in which the forbidden band has a sufficiently small width to convert the photons into electron-hole pairs but in which the material is not necessarily identical with the material of the layers 32 . . . 40. In particular, it is possible to create a potential barrier within the valence band of the layer 16 with respect to the absorption layer 15 by employing a material having the same forbidden band as the layer 15 but with $N^+$ type doping which creates a potential well within the conduction band and a barrier within the valence band. The same applies to fabrication of the layers 31, 33, 35, 37, 39.

The invention is applicable in particular to television camera tubes and to image intensifier tubes.

What is claimed is:

1. A photocathode having a low dark current comprising a absorption layer consisting of $P^+$ type semiconductor material having a forbidden band of sufficiently small width to convert the photons of the light to be detected into electron-hole pairs and further comprising at least one additional layer consisting of semiconductor material such as to ensure that said additional layer has the highest possible potential barrier within the valence band while permitting good transmission of electrons, the thickness of said additional layer being of sufficiently low value to permit the passage of electrons by tunnel effect with high probability but of sufficiently high value to stop the greater part of a hole current.

2. A photocathode according to claim 1, comprising a plurality of additional first layers consisting of semiconductor material such as to ensure that said additional layers create the highest possible potential barriers within the valence band while permitting good transmission of electrons, the thickness of each additional layer being of sufficiently low value to permit the passage of electrons by tunnel effect with high probability but of sufficiently high value to stop the greater part of the hole current, the first layers being separated by additional second layers consisting of P+ type semiconductor material in which the forbidden band is of sufficiently small width and in which the thickness is sufficient to convert the photons of the light to be detected into electron-hole pairs.

3. A photocathode according to claim 1, wherein the semiconductor material of the additional layer consists of $Ga_{0.6}Al_{0.4}As$ and has a thickness of 0.003 micron.

4. A photocathode according to claim 1 and further comprising means for biasing the absorption layer in order to accelerate the electrons released by the photons.

5. A photocathode according to claim 1 including a plurality of said first layers.

* * * * *